United States Patent [19]

McMahon et al.

[11] Patent Number: 4,846,030

[45] Date of Patent: Jul. 11, 1989

[54] SCRAP REMOVAL APPARATUS AND METHOD

[75] Inventors: Raymond McMahon, Naperville; John C. Jellovitz, Lake Barrington; James T. Vaile, Brookfield; Gregory J. Renn, Naperville, all of Ill.

[73] Assignee: Baldwin Technology Corporation, Countryside, Ill.

[21] Appl. No.: 121,320

[22] Filed: Nov. 16, 1987

[51] Int. Cl.[4] ..... B26D 7/18

[52] U.S. Cl. ..... 83/27; 83/112; 83/113; 83/154; 83/155; 83/346; 198/693

[58] Field of Search ..... 83/27, 112, 113, 115–117, 83/151, 154, 155, 155.1, 102, 107, 346, 423; 198/692, 693

[56] References Cited

U.S. PATENT DOCUMENTS

| | | | |
|---|---|---|---|
| 2,381,955 | 8/1945 | Hoffman et al. | 83/154 X |
| 3,186,274 | 1/1965 | Winkler et al. | 83/152 X |
| 3,270,602 | 9/1966 | Kirby et al. | 83/154 X |
| 3,651,724 | 3/1972 | Huffman | 83/115 X |
| 3,893,359 | 7/1975 | Gregoire | 83/154 |
| 4,640,165 | 2/1987 | McMahon et al. | 83/346 |

*Primary Examiner*—Frank T. Yost
*Assistant Examiner*—Eugenia A. Jones
*Attorney, Agent, or Firm*—Neuman, Williams, Anderson & Olson

[57] ABSTRACT

This application discloses removing scrap trimmed from a moving web with a series of pins mounted upon a disc which brings the pins into an impaling engagement in the scrap. The movement of the pins into such engagement is carefully synchronized between the cutting roller and the pins. The scrap is removed from the pins by causing it to be grasped between an abutment on one side and a nip roller on the other side and pulled from the pins at the same time as the pins are being withdrawn.

12 Claims, 4 Drawing Sheets

FIG. 3
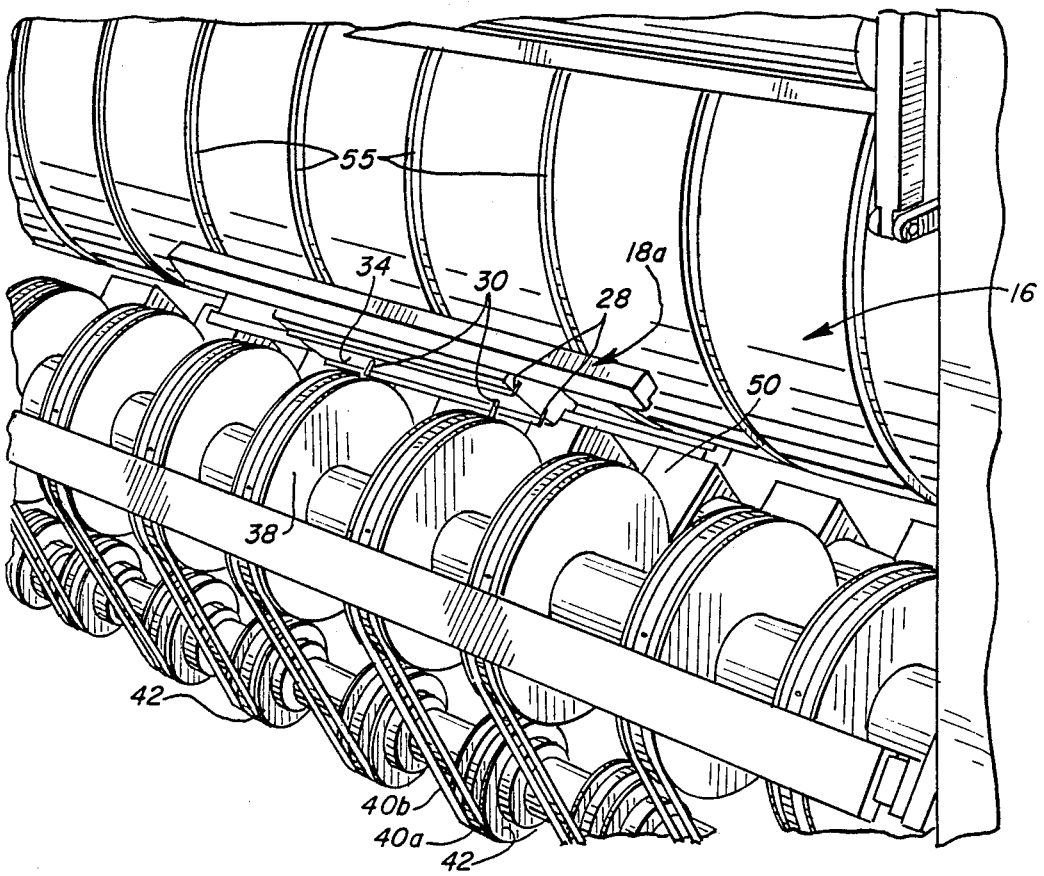
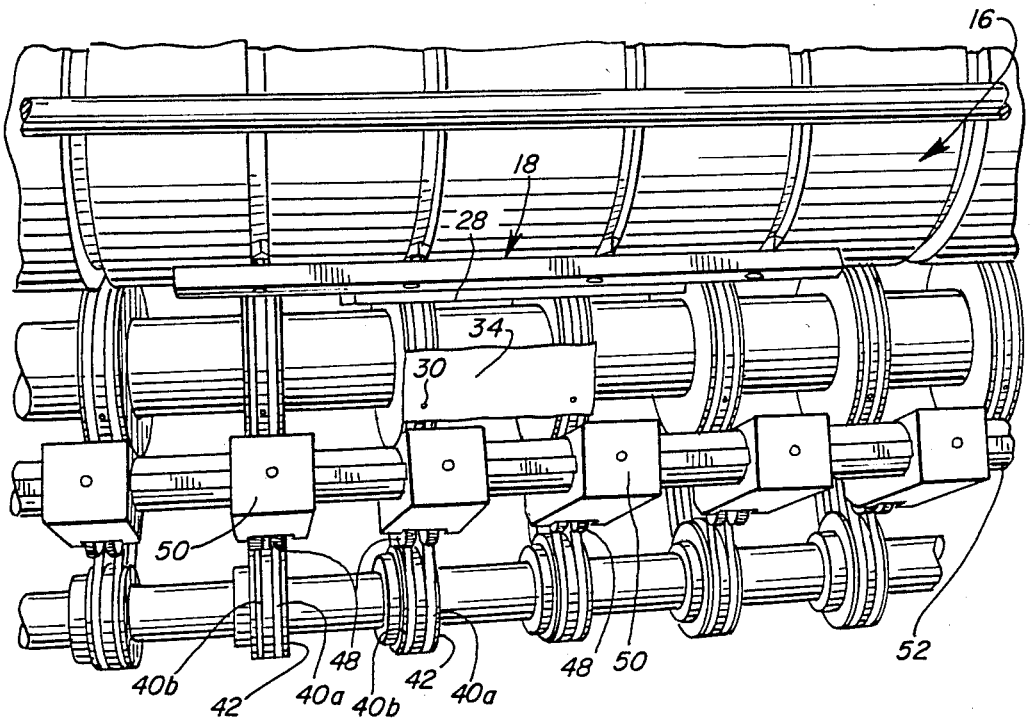
FIG. 4

SCRAP REMOVAL APPARATUS AND METHOD

BACKGROUND OF THE INVENTION

The present invention relates to apparatus for removing trim which is severed from a web of material, such as paper, as the web is passed between an anvil roller and a cutting roller in a rotary cutter. More particularly, the invention relates to moving a set of pins into position to impale the trim or scrap on the pins as it is cut from the web, and then moving the pins with scrap impaled thereon past an abutment which lifts the scrap from the pins. In a preferred form of the invention the abutment is a belt moving alongside and away from the pins as the pins pass the belt, thus combining the lifting engagement of the moving belt on the scrap with the movement of the pins past and away from the belt. A nip roller may be associated with the belt by being moveable onto it to seize the leading edge of the scrap between the belt and the roller as the pins are withdrawn from the scrap. In another form of the invention the abutment may be a comb through which the pins, initially with scrap impaled upon them, are passed, and having an adjacent, cooperative nip roller moveable onto or engaged upon the comb to seize the scrap between the roller and the comb as the pins are withdrawn from the scrap.

Heretofore, in apparatus for stripping scrap from a web which has been severed into sheets, or from a portion of a web which has been trimmed such as in cutting it to form envelope windows, the scrap pieces have been impaled upon pins to pull the scrap out of the path of the trimmed products formed from the web. Once the scrap pieces are impaled, the pins are moved arcuately to pass them through a comb. There, as the pins are moved through and past the teeth of the comb, the pieces of scrap are scraped off the pins, thence to fall from the comb and be removed, such as by letting them fall into a hopper which is removed as it becomes filled, or by vacuuming the pieces of scrap away.

Such is the arrangement of U.S. Pat. No. 3,893,359 to Gregoire, for example. A series of radially extending impalement pins are arranged along a stripping roller in a rotary cutter. The rotary cutter includes an anvil roller against which radially extending longitudinally arranged parallel knife blades on the cutting roller are brought to bear as a moving web is passed between the anvil and cutting rollers. Adjacent the stripping roller a comb is mounted in a position to require the pins to pass through its teeth. In operation, the knife blades sever a piece of scrap from the web, and the severed piece remains between the blades momentarily. However, as the cutting roller continues to rotate the severed piece of scrap between the blades is brought opposite the set of impalement pins. The pins are rotated into penetration of the scrap, and, thus impaled, the scrap is drawn from between the knife blades and carried away on the stripping roller. Thereafter, the severed piece of scrap is carried by the pins around the stripping roller to a point where the pins pass through the teeth of the comb. Thus the pins are withdrawn from the scrap as the stripper roller continues to rotate past the comb.

A generally similar form of scrap stripping apparatus is shown and described in a U.S. Pat. to McMahon et al., U.S. Pat. No. 4,640,165 issued Feb. 3, 1987. In that application, the comb is illustrated as being somewhat curved about the cutting roller near the extremities of its teeth.

Other patents which may be of interest in this field are the following U.S. Pat. Nos. 3,270,602 to K. Kirby et al., 3,186,274 to R. Winkler et al., and 2,381,955 to L. Hoffman et al. In the last-mentioned patent, a pivotally mounted doctor blade is urged by a spring against a roller carrying a set of picker pins. The base of the doctor blade is supported in a bracket which can be adjusted pivotally to dispose the blade toward or away from the roller carrying the picker pins, and the base of the doctor blade can also be moved longitudinally along the roller so that the teeth of the doctor blade can properly intercept the pins.

In these and other arrangements of the prior art the blades or combs have had to be adjusted so that their teeth intercept the scrap with the points of the teeth between the pieces of scrap and the body of the stripper roller. As the cutters are used, the press operators must keep a watchful eye upon their stripping operations to be sure that the stripping teeth continue to function and do not block or pile up scrap. Vibrations within the equipment as the cutters are run at high speeds can sometimes cause the stripping teeth to get out of adjustment. And also, when the cutters are run at high speeds, the rapid movement of the scrap pieces onto the stripping teeth may sometimes cause the scrap to tear or otherwise be incompletely removed because portions stick on the impaling pins.

This invention also eliminates the need for pins in the cutting anvil which greatly improves anvil life and flexibility especially when cutting complex die cut shapes.

SUMMARY OF THE INVENTION

These and other problems of the prior art are overcome by the apparatus and method of the present invention in which the scrap pieces are removed from impalement on the pins by combining the lifting of an abutment member acting upon the scrap piece with the gripping of the scrap piece against the abutment member as the impalement pin is withdrawn. In the preferred form of the invention a nip roller is applied to the abutment member at a point which the scrap piece reaches just as it has come in contact with the abutment member. The leading edge of the scrap is grasped between the roller and the abutment member as the impalement pin is withdrawn. Also, although the abutment member may take the form of a moving belt, traveling beneath the portion of the web which is severed as scrap and thus does not need to be inserted beneath the scrap piece's edge, a more rigid comb may be used in combination with a gripping means such as a nip roller which bears upon the teeth in the comb on the opposite side of the teeth from the stripping roller bearing the pins.

In one form of the present invention a disc is provided, positioned adjacent the cutting roller, having an outwardly facing surface portion around the outer edge of the disc which faces the convex surface of the cutting roller as the disc and the cutting roller rotate. On the outwardly facing surface portion of the disc a plurality of scrap removal pins is arranged having scrap impalement portions extending outwardly, or radially, from the disc. The disc is arranged, and its timing closely regulated as it rotates, to bring the pins into engagement with scrap portions being trimmed from a moving web. Also, there is a track on the outwardly facing surface portion of the disc adjacent the scrap removal pins. A belt is disposed upon the track, successively engaging and disengaging the track along successive portions of the belt as the disc rotates and the belt is moved. The impalement portions of the scrap removal pins are arranged in and moveable along a path which passes the edge of the belt as the disc rotates, and, the distance between the path of the impalement portions of the pins and the edge of the belt being less than the distance any scrap trimmed from the web and impaled on the pins extends outwardly from the pins prior to movement of the impalement portions past the belt during rotation of the disc, the belt is disposed to intercept and remove trimmed scrap off the pins as the impalement portions of the pins move past the belt. A nip roller is located in an engaging relationship with the belt at a point along the belt to engage and hold any scrap carried by the pins between the nip roller and the belt during movement of the pins past the belt. After the scrap is removed from the pins, it is passed between the nip roller and the belt by the joint movement of the roller and the belt, and is thereafter dropped into a hopper or other removal means.

OBJECTS OF THE INVENTION

It is an object of the present invention to provide a scrap stripping apparatus to remove scrap which has been severed from a moving web for cutting devices such as a rotary cutter, a die cutter, or a gap cutting sheeter wherein the severed strip of scrap, once it is disposed upon a pin or pins impaling the scrap and moved out of the main path of the web, is seized between an abutment member and a roller as the impaling pin is withdrawn. Hereinafter, unless the context otherwise dictates, the term "rotary cutter" will be used in the broad sense which incorporates devices such as those just noted.

It is also an object of the present invention to provide a scrap stripping apparatus for a rotary cutter wherein the abutment member against which the severed piece of scrap is seized is a moving belt travelling at a coordinated speed with the roller bearing the scrap stripping pins and maintaining engagement with the scrap throughout the time the impalement pin (or pins) is withdrawn.

It is a further object of the present invention to provide a scrap stripping apparatus for a rotary cutter wherein, in one form, an abutment member is maintained in moving engagement with the scrap as a pin (or pins) impaling the scrap is withdrawn therefrom.

It is a still further object of the present invention to provide a scrap stripping apparatus for a rotary cutter wherein the moving parts which engage the severed piece of scrap are brought into and out of contact with the piece of scrap as the apparatus is operated and do not require frequent repositioning.

It is still a further object of the present invention to provide a scrap stripping apparatus for a rotary cutter wherein the moving parts which bring the engagement portions of the scrap stripping pins into contact with the scrap impart little or no backlash to the discs on which the pins are mounted.

Another object of the invention is to provide a scrap stripping apparatus for a rotary cutter wherein the moving parts are self-cleaning and are unaffected in operation by the accumulation of dust or other debris, are durable, and are of simple construction.

Other objects and advantages of the scrap stripping apparatus and method of the present invention will be apparent to one skilled in the art from the following description and claims, and from the drawings appended hereto.

DESCRIPTION OF THE DRAWINGS

FIG. 3 is an enlarged perspective view of a portion of the rotary cutter apparatus in FIG. 1 after the knife roller has been rotatably advanced, along with the other rollers, from the position shown in FIG. 1;

FIG. 4 is a perspective view of the apparatus shown in FIG. 3 taken from the opposite side of the apparatus from that shown in FIG. 3 after the roller and pins on which the scrap has been impaled have been rotatably advanced from the position shown in FIG. 3;

It should be understood that the drawings are not necessarily to scale and that the embodiments sometimes are illustrated in part by phantom lines and fragmentary views. In certain instances, details of the actual structure which are not necessary for an understanding of the present invention may have been omitted. It also should be understood, of course, that the invention is not necessarily limited to the particular embodiments illustrated herein.

DETAILED DESCRIPTION OF THE PREFERRED EMBODIMENT

Figure 1:
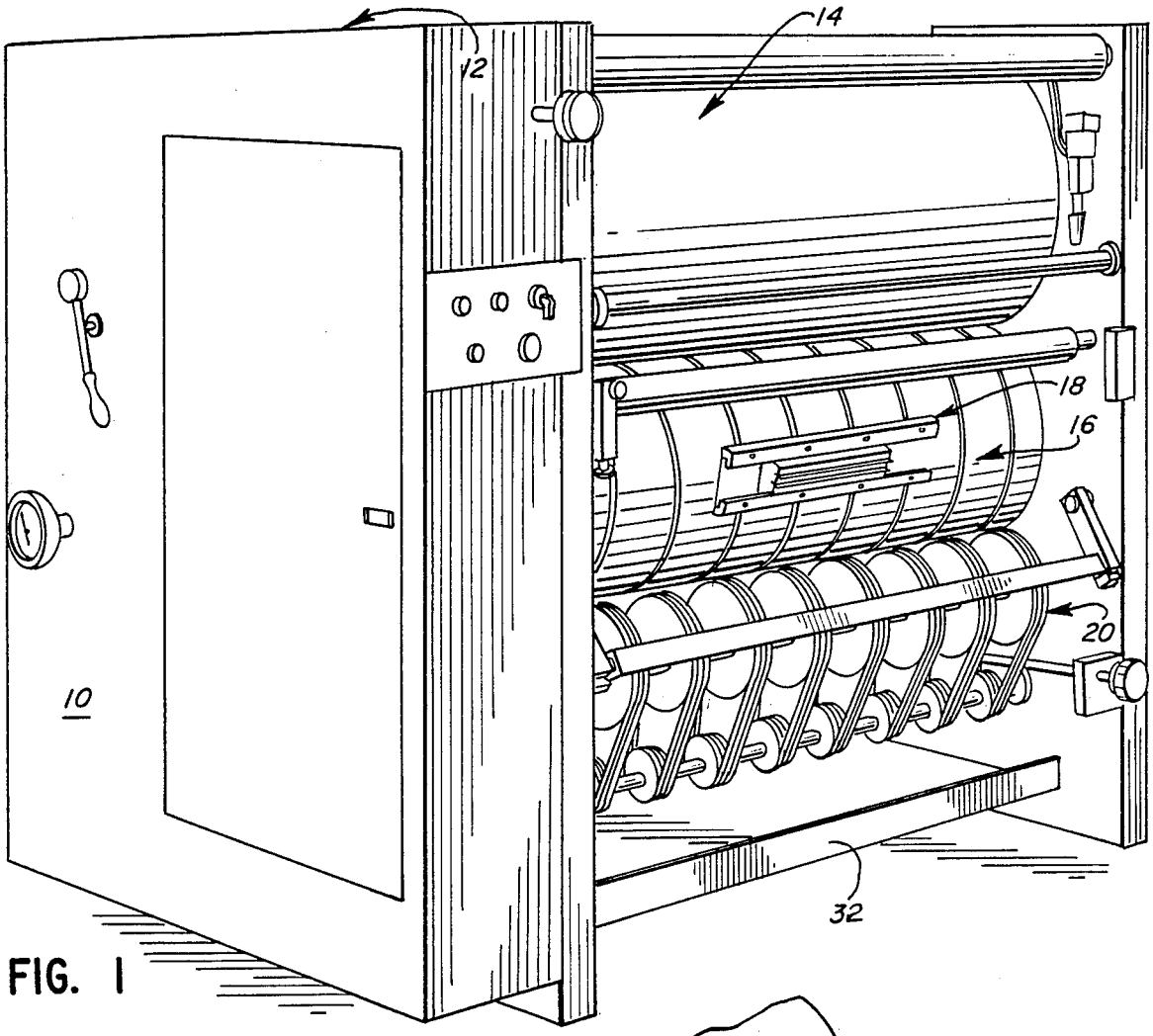
FIG. 1 is a perspective view of a rotary cutter showing an anvil roller uppermost in the apparatus, a knife roller immediately below the anvil roller, and the scrap stripping apparatus of the present invention below the knife roller.

In the rotary cutter 10 shown in FIG. 1, a frame 12 supports an anvil roller 14 and a knife roller 16. The knife roller has a knife assembly 18 mounted on its outer surface, the assembly 18 being shown in larger detail in cross-section in FIG. 5 and more fully described in the above-mentioned U.S. Pat. No. 4,640,165. Below the knife roller and knife assembly is scrap stripping apparatus 20 of the present invention. The view of the rotary cutter 10 shown in FIG. 1 is the rear side of the cutter, i.e., the output side, although no web or portion thereof is illustrated issuing from the cutter. Thus, the side of the rotary cutter 10 shown in FIG. 1 is to the left of the apparatus illustrated in FIG. 2. While such an orientation has been made for purposes of describing the present invention in context, it will be recognized that the relationship illustrated may be varied without materially departing from the environment of the invention. As shown, the anvil roller 14 rotates during operation of the cutter in the direction shown by the arrow 22 in FIG. 2, and the knife roller operates in the direction shown by the arrow 24 in FIG. 2. A web of material, such as paper (not shown), which would be trimmed between the anvil and knife rollers enters between these rollers from the right side of FIG. 2.

Figure 2:
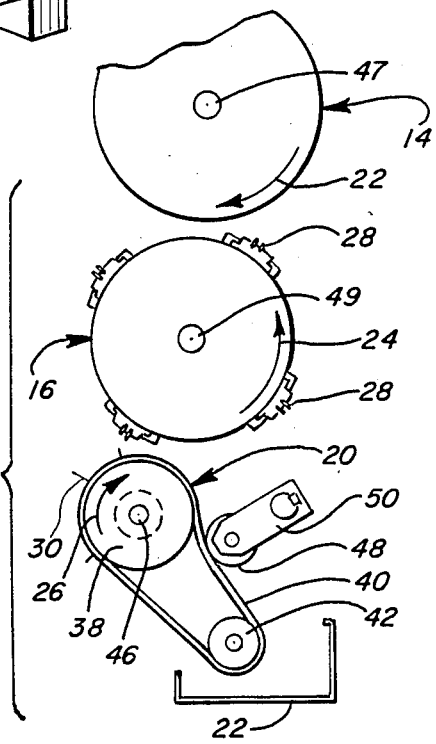
FIG. 2 is a schematic transverse sectional view of the anvil roller, knife roller and scrap stripping apparatus shown in FIG. 1.

The scrap stripping apparatus 20 of the present invention operates in the direction of the arrow 26 in FIG. 2. After strips of scrap are trimmed from the web by the pairs of knife blades 28, a procedure which will shortly be described, and are picked from between the blades by scrap removal pins 30, they are drawn from the pins by the stripping apparatus 20 and transmitted, in part by gravity and in part by affirmative movement of the apparatus, to a receptacle 32 from which they may be removed by any conventional means, such as a vacuum.

The need to pick out and dispose of scrap trimmed from a web moving at high speed may be occasioned by a number of circumstances. The most common of these circumstances, perhaps, is when the web to be cut must be severed into sheets having a length which is unevenly divisible into the circumference of the knife roller. Another circumstance occurs when scrap is trimmed from the side of the web being processed. Still another circumstance can occur when a portion is cut out of the web, as by a die, and the resultant scrap must be picked out of the die. Other such circumstances will occur readily to those skilled in the art.

The knives for cutting the web are spaced apart on a cutting or knife roller as illustrated in FIG. 2, and in advanced forms of cutters a pair of knife blades may be positioned closely beside each other as in the individual blade assemblies 18. While the present invention is shown in cooperative arrangement with blades mounted closely together (see FIG. 5), it may be appropriately used, too, in cooperation with blades mounted farther apart as in U.S. Pat. No. 3,893,359.

Figure 5:
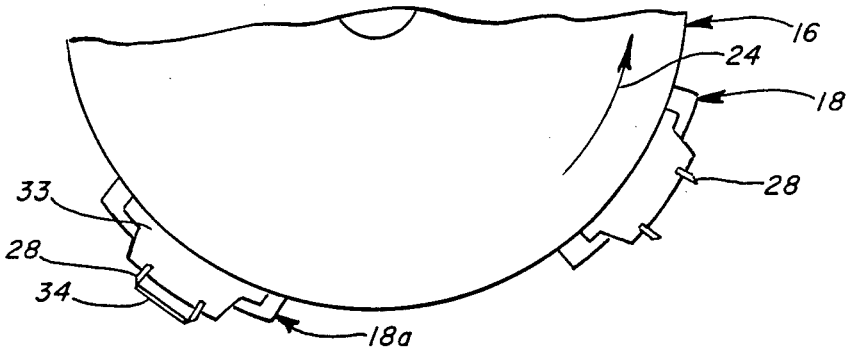
FIG. 5 is an enlarged transverse sectional view of a portion of the knife roller and scrap stripping apparatus shown in FIG. 2.
Figure 5:
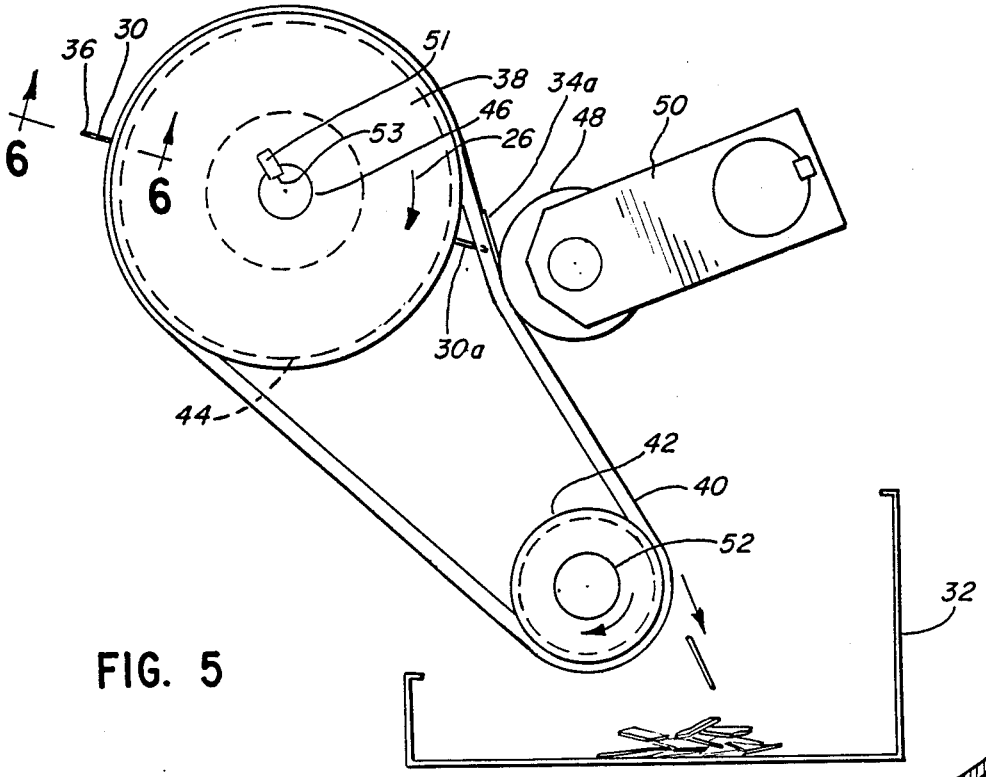

In the enlarged view illustrating a portion of the knife roller 16 and two knife assemblies 18 and 18*a*, FIG. 5, a pair of knife blades 28 is shown in each of the knife assemblies. Knife roller 16 rotates counterclockwise in the direction of arrow 24 to bring a knife assembly 18 into cutting engagement on a web (not shown), so that the knife blades 28 in the assembly 18 cut the web against an anvil roller such as roller 14 (not shown in FIG. 5). In the course of cutting the web, a piece of it, shown as scrap piece 34 in FIG. 5, usually becomes wedged between the blades 28. In some instances, such as in certain types of web materials, it may be desirable to positively hold the trimmed out portion, or "chip," 34 in position with a perforating blade 33 which penetrates the waste chip but does not cut it, as shown in FIG. 5. It has been found that pieces of scrap wedged or held between the cutter blades in this manner can be removed successfully by impaling them on a scrap removal pin 30 having an impalement portion 36 at its outer end. The pin 30 is carried by a wheel or disc 38 moving in a direction counter to the direction of revolution of the knife roller, as shown by arrow 26. Wheel 38 is revolved at a speed which brings the pins 30 to interpose each pair of knife blades 28 and thrust the impalement portions 36 of the pins into the strips of scrap 34 disposed between the blades. As the knife roller and scrap removal wheel continue to revolve, the pins 30 move apart from the knife blades, and since the strip of scrap is impaled upon the pins, they carry the strip of scrap 34 free of the blades 28 (and free from blade 33 if one is used).

The wheel or disc 38 may be driven by a belt 40 engaging both the disc 38 and a drive wheel 42, although, as will be described below, it has been found to be preferable and more accurate to drive disc 38 with a series of gears located at the ends of the roller shafts at the left end of the cutter illustrated in FIG. 1. When, however, a belt drive is utilized, belt 40 most advantageously is engaged upon the wheel or disc 38 on the disc's outside circumferential surface alongside the bases of the scrap removal pins 30. One manner of such engagement is to form a track 44 in that circumferential surface of the disc so that, as the belt moves, it successively engages and disengages the track as the disc 38 is revolved.

Preferably, however, the rod 46 on which the disc 38 is mounted may be the drive member, and wheel 42 is utilized as a passive mount or idler for belt 40, thus maintaining engagement of the belt 40 around disc 38. In this case, still, as in the case of using wheel 42 as a driving member, the belt 40 serves the function of being an abutment against which the impalement pins bring the strips of scrap 34 after the strips have been removed from between the knife blades 28. In the arrangement of elements illustrated in FIG. 2, rod 46 may be driven either by a belt (not shown) extending between rod 46 and the shaft 47 on which the anvil roller 14 is mounted, or alternatively, the rod 46 and the shaft 47 may be connected through a set of gears as explained below. One location for such a connecting drive belt or set of gears is at the left side of the arrangement shown in FIG. 1 outside of the frame 12. The disc 38 may be similarly driven by a belt or set of gears connecting the rod 46 with the shaft 49 on which knife roller 16 is mounted. Wheel 42 may be mounted so that it is free to turn in its bearing assembly. Bracket 50 may be disposed so that it is adjustable in an arc in relation to wheel or disc 38 via a handwheel at the front of the machine.

In any of the just described arrangements for driving rod 46, it is highly desirable to synchronize carefully the rate of revolving disc 38 with the rate of revolving the knife roller 16, and to maintain that synchronization. The pins 30 will thus be disposed to intercept the scrap regularly between each pair of the knife blades 28 mounted in a holder. It has been found advantageous to drive the disc 38 at a speed of revolution which is twice the rate of revolution of the knife roller 16. That arrangement normally will bring pin 30, for example, which as illustrated in FIG. 5 is one of two pins 180° apart on disc 38, into successive impaling engagement with scrap pieces disposed in pairs of knife blades arranged 90° apart around the circumference of the knife roller 16. Manifestly, more than two pin mountings may be used, if desired, with corresponding additional knife mountings. For example, three impalement pin mountings may be arranged 120° apart around the disc 38, and if such an arrangement were utilized, it would require six knife mountings, or "trim positions" centered 60° apart around the knife roller 16.

It has been found to be advantageous to provide a belt member mounted on each side of the pins 30. Thus, the track 44 may be divided into a pair of tracks 44*a* and 44*b*, as shown in FIG. 6, and the belt member may be divided into the substantially parallel strands 40*a* and 40*b* shown in FIG. 6. As may be readily visualized in this Figure, a piece of scrap impaled on pin 30 (not shown) will be likely to engage both strands 40*a* and 40*b* as disc 38 is rotated and then will be lifted on each side of the pin equally as the pin passes the strands during rotation of the disc 38. Whether the belt is formed as one member on one side of the pins 30, or as a pair of strands, one on each side of the pins 30, the movement of the belt away from the disc 38 as the belt disengages from the disc and travels toward wheel 42 exerts a lifting engagement on the underside of a strip of scrap during separation of the scrap from a pin 30.

Figure 6A:
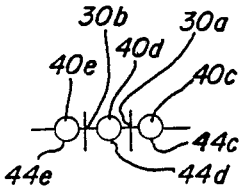
FIG. 6A is a fragmentary sectional view of a modified and alternative form of the portion of the apparatus shown in FIG. 6.
Figure 6:
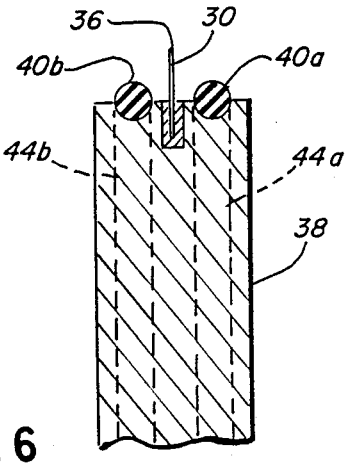
FIG. 6 is an enlarged transverse sectional view of a portion of the scrap stripping apparatus shown in FIG. 5, taken along the line 6—6 in FIG. 5.

FIG. 6A illustrates a still further arrangement which may be utilized. Three strands of belt may be used, such as 40*c*, 40*d* and 40*e*, positioned in tracks 44*c*, 44*d* and 44*e*. Thus, a pair of pins 30 may be adopted, such as shown at 30*a* and 30*b*.

Intermediate the disc 38 and roller 42 the belt 40 may be engaged by a nip roller 48 positioned to seize a piece of scrap such as piece 34*a* between the nip roller and the belt as the scrap is being lifted off the end of a scrap removal pin such as pin 30*a*. The nip roller 48 is mounted in the bracket 50 which is positioned to bring the roller into contact with belt 40 close enough to the disc 38 to engage the piece of scrap 34*a* very close to the point where the belt engages and begins to lift the scrap piece off the pin. The roller thus cooperates with the belt to seize the piece of scrap and affirmatively pull it off and away from the pin. Also the pin, being fixed to the disc 38, is affirmatively pulled away from the piece of scrap as the scrap is being held between the roller and the belt and moved away from the pin. Various means may be used to insure firm seizure and holding of the piece of scrap between the roller and the belt, such as a surface on the nip roller or the belt which has been roughened. However, it has been found that the surface of nip roller 48 which faces the disc 38 and belt 40 may be formed with a groove to accept the configuration of the belt, thus providing mating uneven surfaces for the scrap to be seized between.

In the perspective views of FIGS. 3 and 4 a series of the discs 38 and nip rollers 48, as above described, are shown with belt portions 40*a* and 40*b* engaged upon them. In FIG. 3, as in FIG. 5, a pair of knife blades 28 in the knife assembly 18*a* contains a strip of scrap 34 which has been severed from a web (not shown). Scrap removal pins 30 mounted on discs 38 penetrate and impale the scrap strip 34 during synchronized revolutions of the discs 38 and the knife roller 16.

In FIG. 4, the strip of scrap 34 impaled upon pins 30 in FIG. 3, has been picked from between knife blades 28 and moved away from the knife roller. Carried by the pins, the scrap strip 34 is about to be moved into the point of engagement between nip rollers 48 and the belt portions 40*a* and 40*b* and be seized there by the belt portions 40*a* and 40*b* and the roller 48, as shown in FIG. 5. Brackets 50 in which the nip rollers 48 are mounted, are affixed to a shaft 52 and positioned so as to bring the nip rollers 48 in contact with belt portions 40*a* and 40*b* close enough to discs 38 to seize the strip of scrap 34 while it is impaled upon pins 30.

It will be apparent from the foregoing description that the disc 38 presents the pins 30 for engagement in scrap strips which are as wide as the distance between the knife blades 28 in a knife assembly 18. In order to accomplish impaling the scrap strips closer to one knife blade or the other, the position of the disc 38 on the rod 46 may be varied, thus varying the position of the pins from one set of radii (extended) of the rod 46 to another set. The discs 38 are positioned on rod 46 by means of a key 51 mounted in a keyway 53 in rod 46, as shown in FIG. 5. The discs are freely rotatable around rod 46 when they are first assembled upon the rod, but then they are fixed in position by fixing key 51 in place in the keyway 53 and against the disc 38. Use of the key 51 also permits accurate alignment of the pins 30 down the length of the rod 46 when a plurality of discs are used, such as in the assembly shown in FIGS. 3 and 4.

The variety of radial positions into which the pins 30 may be placed also provides a user with an opportunity to lengthen the life of the anvil roller 14. Knife assembly 18 can be positioned in an almost infinite number of places about the circumference of the knife roller 16 by locking it in place wherever a machine operator chooses in tracks 55 according to the job to be trimmed. Whenever the job permits some variation in the length of the section of web to be trimmed, the operator may vary the position of the knife blade in the tracks 55. Then, as above described, the discs 38 may be positioned to accept the scrap strips in the knife blades. The adjustable positioning of the pins 30 and of the knife blades permits an operator to vary the places where each knife blade strikes the anvil roller, thus vastly reducing the impacts of the knife blades on the same spot in the surface of the anvil roller.

Figure 7:
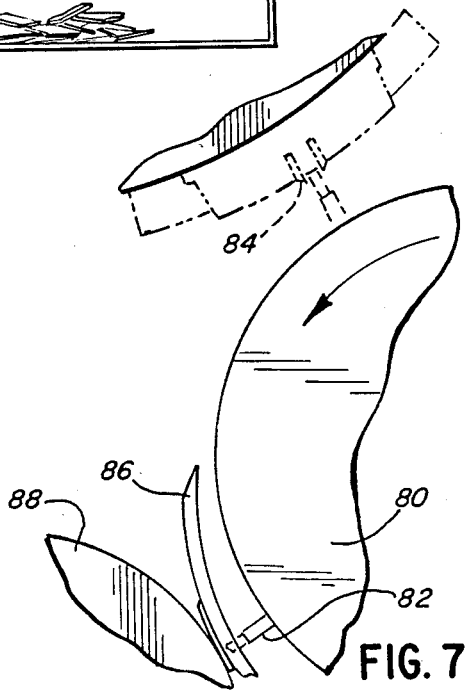
FIG. 7 is a fragmentary sectional view of an alternative embodiment of the scrap stripping apparatus shown in FIG. 5.

FIG. 7 illustrates a fragmentary portion of a modified and alternative embodiment of the present invention. Disc 80 carries scrap removal pins 82 which pick trimmed-out scrap pieces from between knife blades 84 shown in phantom. A comb 86 or other rigid structure is mounted in a fixed position adjacent the disc 80 to be intercepted by the pins 82 carrying scrap from between the knife blades. Alongside the comb 86, and located so that the comb is between it and the disc 80, is a nip member 88. The nip member may take the form of a roller or a wheel which revolves against the comb and seizes the scrap pieces of the web against the teeth of the comb. Such engagement affirmatively holds the strip of scrap against the comb as the impalement pins 82 are pulled out of the scrap during rotation of the disc 80 past the comb. Also, as the nip member revolves, it pulls the scrap strip along the comb and away from the impalement pins 82.

Figure 8:
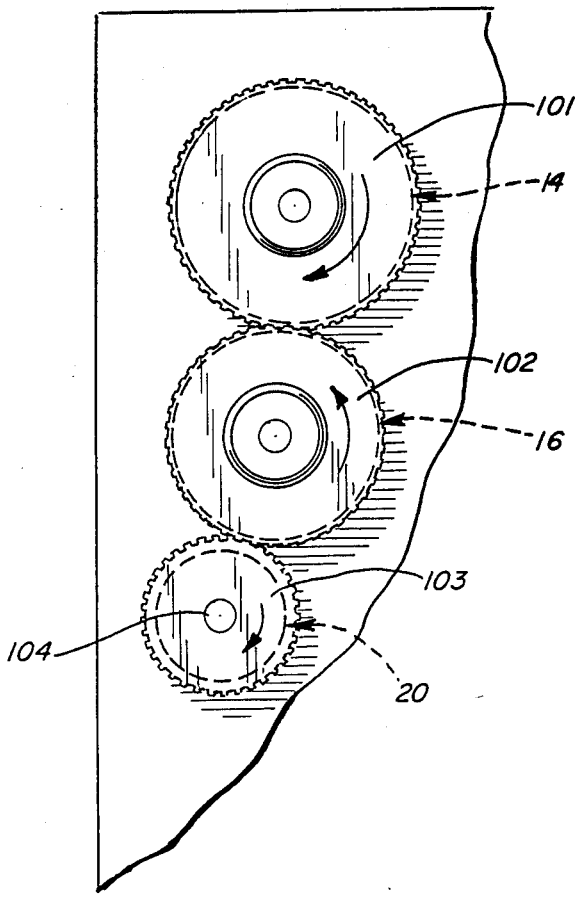
FIG. 8 is a fragmentary view of a drive mechanism which may be disposed on the ends of the roller mounting shafts (not visible) at the left end of the rotary cutter shown in FIG. 1.

In the series of gears shown in FIG. 8, one arrangement of rotating and synchronizing the anvil cylinder, knife cylinder and chip removal discs is illustrated. Helical gear 101 is attached to the end of the shaft 47 on which the anvil cylinder 14 is mounted, and helical gear 102 is attached to the end of the shaft 49 on which the knife cylinder 16 is mounted. Both of the gears 101 and 102 may be mad of steel. A third gear, 103, which is preferably made of Nylon is a helical gear mounted on the end of the shaft 46 on which discs 38 are mounted. In such an arrangement a gear box and a coupling preferably may be utilized to drive the knife cylinder, which in turn transmits power to the anvil cylinder mating helical gear 101. At the same time power is transmitted from gear 102 to the mating helical nylon gear 103. In such an arrangement, also, when a slipable hub 104 is used for mounting the gear 103, precise synchronization of the trim removal pins 30 with the position of the blades 28 on the knife cylinder can be achieved for continuous, accurate and thorough removal of the chip.

While particular embodiments and modifications of the present invention have been shown and described, it will be understood, of course, that the invention is not limited thereto, since further modifications may be made by those skilled in the art, particularly in light of the foregoing teachings. It is, therefore, contemplated by the appended claims to cover any such modifications as incorporate those features which come within the true spirit and scope of the invention.

What is claimed is:

1. The method of removing scrap trimmed from the body of a moving web as the web passes a rotatable cutting roller and a rotatable anvil roller comprising impaling the scrap portion of the web on at least one pin after the scrap portion has been severed from the body of the web, moving the scrap portion impaled on the pin in an arcuate path adjacent to and intersecting a moving belt, and scraping the scrap portion off the pin onto the moving belt.

2. The method of claim 1 which includes engaging the scrap portion against the moving belt by a roller during the scraping of the scrap portion off the pin onto the moving belt.

3. A scrap removal apparatus for engaging and transferring portions of a moving web which have been trimmed from the body of the web as the web passes a rotatable cutting roller and a rotatable anvil roller, comprising at least one disc positioned adjacent the cutting roller having an outwardly facing surface portion disposed about an outer edge of the disc and arranged to face the convex surface of the cutting roller as the disc and the cutting roller rotate, a plurality of scrap removal pins having scrap impalement portions extending outwardly from the outwardly facing surface portion of the disc, a track on the outwardly facing surface portion of the disc adjacent the scrap removal pins, a belt disposed upon the track and successively engaging and disengaging the track along successive portions of the belt as the belt is moved, the impalement portions of the scrap removal pins being arranged in and moveable along a path past the edge of the belt as the disc rotates, the distance between the path of the impalement portions of the pins and the edge of the belt being less than the distance any scrap trimmed from the web and impaled on the pins extends outwardly from the pins prior to movement of the impalement portions past the belt during rotation of the disc, whereby the belt is disposed to intercept and scrape trimmed scrap off the pins during movement of the impalement portions of the pins past the belt.

4. The scrap removal apparatus of claim 3 in which the track includes portions on the outwardly facing surface portion of the disc on both sides of the impalement portions of the scrap removal pins, and the belt includes portions disposed upon the track portions on each side of the pins, the path of the impalement portions of the pins being between the belt portions.

5. The scrap removal apparatus of claim 3 in which the impalement portions of the pins extend outwardly from the disc in radial directions.

6. The scrap removal apparatus of claim 3 in which a plurality of discs are arranged to rotate in spaced-apart relationship to each other along a longitudinal distance along the cutting roller.

7. The scrap removal apparatus of claim 6 in which the impalement portions of the pins on the discs are in-line from one end disc to the other end disc and arranged to simultaneously impale a section of scrap trimmed from the web along a substantial portion of the longitudinal length of the scrap.

8. The scrap removal apparatus of claim 3 in which the track is a channel recessed into the outwardly facing surface portion, and the belt has a cross-sectional configuration which conforms to the cross-sectional configuration of the channel.

9. The scrap removal apparatus of claim 3 in which the disc and the cutting roller are rotated in opposite directions and the speed of the surface of the cutting roller during rotation of the cutting roller is one half the speed of the outwardly facing surface portion of the disc during rotation of the disc.

10. The scrap removal apparatus of claim 3 in which the scrap impalement portions of the pins are carried by the disc into penetrating engagement of the scrap adjacent the cutting roller during rotation of the disc toward the cutting roller, and subsequent to penetration of the scrap are carried by the disc into scraping disengagement of the scrap on the belt during rotation of the disc away from the cutting roller.

11. A scrap removal apparatus for engaging and transferring portions of a moving web which have been trimmed from the body of the web as the web passes a rotatable cutting roller and a rotatable anvil roller, comprising at least one disc positioned adjacent the cutting roller having an outwardly facing surface portion disposed about an outer edge of the disc and arranged to face the convex surface of the cutting roller as the disc and the cutting roller rotate, a plurality of scrap removal pins having scrap impalement portions extending outwardly from the outwardly facing surface portion of the disc, a track on the outwardly facing surface portion of the disc adjacent the scrap removal pins, a belt disposed upon the track and successively engaging and disengaging the track along successive portions of the belt as the belt is moved, the impalement portions of the scrap pins being arranged in and moveable along a path past the edge of the belt as the disc rotates, the distance between the path of the impalement portions of the pins and the edge of the belt being less than the distance any scrap trimmed from the web and impaled on the pins extends outwardly from the pins prior to movement of impalement portions past the belt during rotation of the disc, and a nip roller in engaging relation with the belt at a point along the belt to engage and hold any scrap carried by the pins between the nip roller and the belt during movement of the pins past the belt.

12. The scrap removal apparatus of claim 11 in which the nip roller includes a recessed configuration in the surface of the nip roller engaging the belt and conforming to the portion of the surface of the belt which contacts the nip roller.

* * * * *